US008033863B2

(12) United States Patent
Gutter et al.

(10) Patent No.: US 8,033,863 B2
(45) Date of Patent: Oct. 11, 2011

(54) MODULAR CONNECTOR PLUG HAVING A WIRE GUIDE FILTER WITH AN IMPEDANCE CONTAINING PORTION AND A CABLE GUIDE PORTION

(75) Inventors: David Henry Gutter, Felton, PA (US); Jennifer Allison, Seven Valleys, PA (US); Yakov Belopolsky, Harrisburg, PA (US); Jason Cartwright, Yoe, PA (US); Richard D. Marowsky, York, PA (US)

(73) Assignee: Bel Fuse (Macao Commercial Offshore) Limited, Andar H-K (MO)

( * ) Notice: Subject to any disclaimer, the term of this patent is extended or adjusted under 35 U.S.C. 154(b) by 0 days.

(21) Appl. No.: 12/925,752

(22) Filed: Oct. 28, 2010

(65) Prior Publication Data

US 2011/0104934 A1 May 5, 2011

Related U.S. Application Data

(60) Provisional application No. 61/280,401, filed on Nov. 3, 2009.

(51) Int. Cl.
*H01R 13/66* (2006.01)

(52) U.S. Cl. ..... 439/620.07

(58) Field of Classification Search ..... 439/620.07, 439/620.14, 460, 490, 599, 598
See application file for complete search history.

(56) References Cited

U.S. PATENT DOCUMENTS

| | | | | |
|---|---|---|---|---|
| 4,963,098 | A | 10/1990 | Myer et al. | |
| 5,489,220 | A * | 2/1996 | Hanna et al. | 439/620.07 |
| 5,630,734 | A * | 5/1997 | Phillips, Jr. | 439/620.07 |
| 5,823,826 | A * | 10/1998 | Ward et al. | 439/620.07 |
| 6,062,908 | A * | 5/2000 | Jones | 439/620.07 |
| 6,152,775 | A * | 11/2000 | Pavlovic | 439/620.07 |
| 6,875,046 | B2 * | 4/2005 | Chiu et al. | 439/460 |
| 7,510,440 | B2 * | 3/2009 | Lin et al. | 439/620.07 |
| 7,547,232 | B2 * | 6/2009 | Johannes et al. | 439/620.07 |
| 2006/0035514 | A1 * | 2/2006 | Yohn et al. | 439/460 |

FOREIGN PATENT DOCUMENTS

| | | |
|---|---|---|
| EP | 1 988 611 | 11/2008 |
| KR | 1020060039918 | 5/2006 |
| KR | 1020080109633 | 12/2008 |

OTHER PUBLICATIONS

PCT International Search Report for PCT/US2010/002852; date of mailing: Apr. 28, 2011.

* cited by examiner

*Primary Examiner* — Chandrika Prasad
(74) *Attorney, Agent, or Firm* — Cozen O'Connor

(57) ABSTRACT

A modular connector plug for high speed applications includes a wire guide filter at least partially situated in the conductor-receiving cavity of the housing of the plug. The wire guide filter includes an impedance containing portion comprising a longitudinally extending body having a plurality of longitudinally extending passageways and an internal cable guide portion comprising a longitudinally extending body defining a plurality of longitudinally extending passageways.

39 Claims, 17 Drawing Sheets

FIG. 10
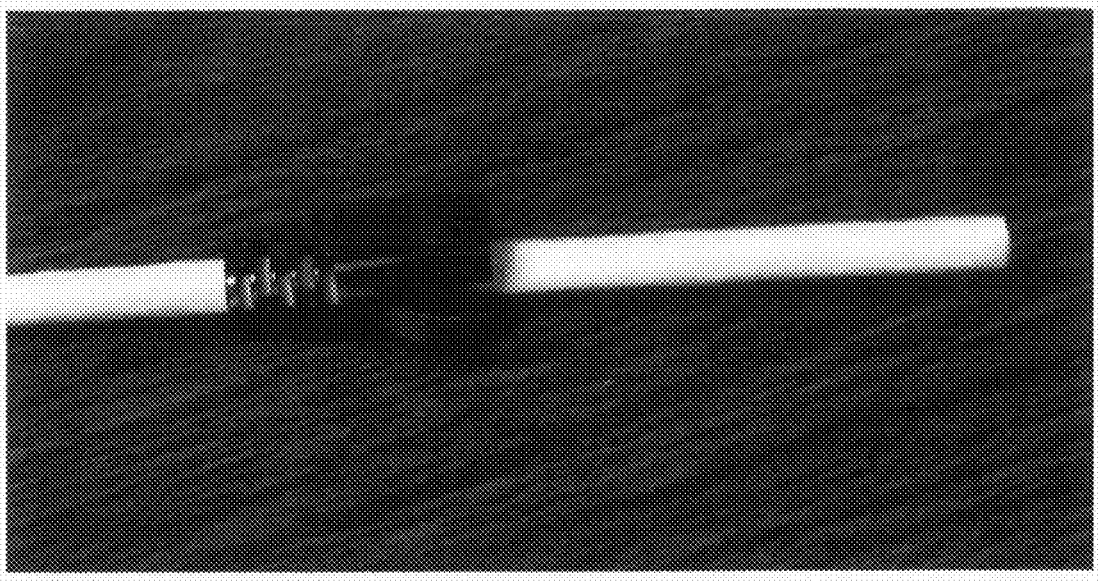
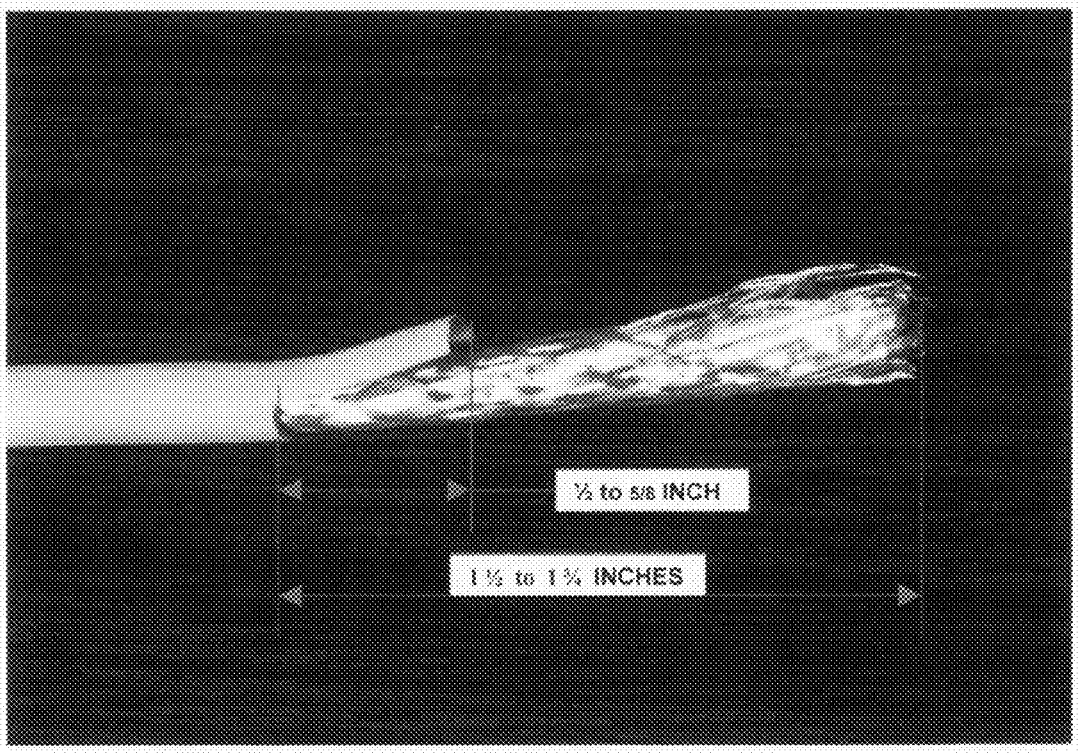
FIG. 11

FIG. 12
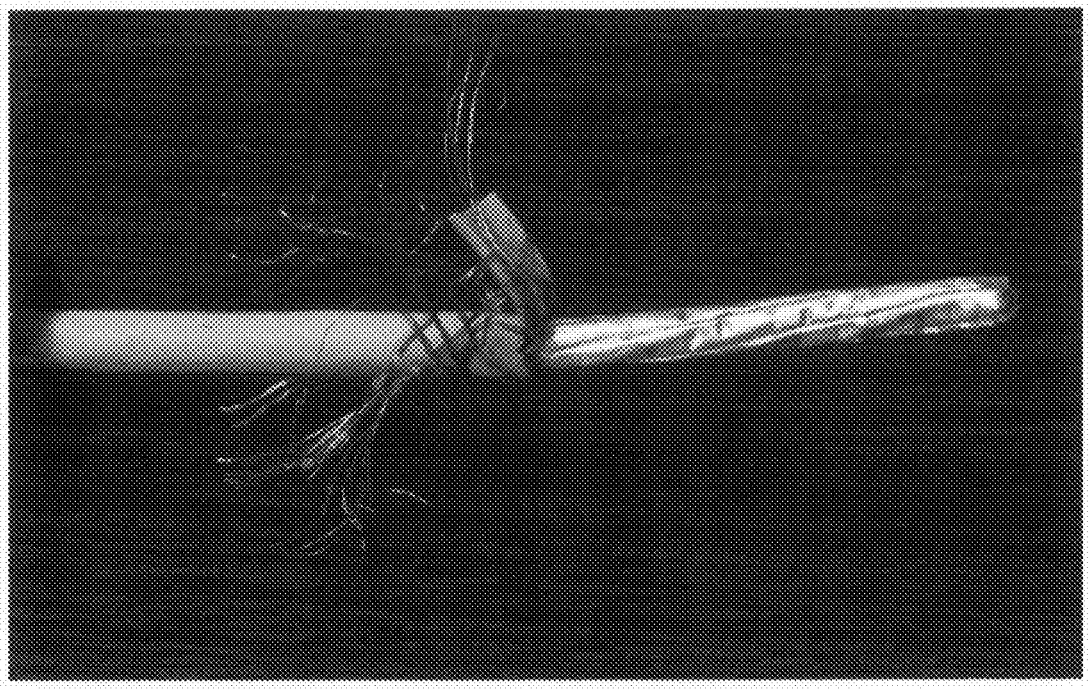
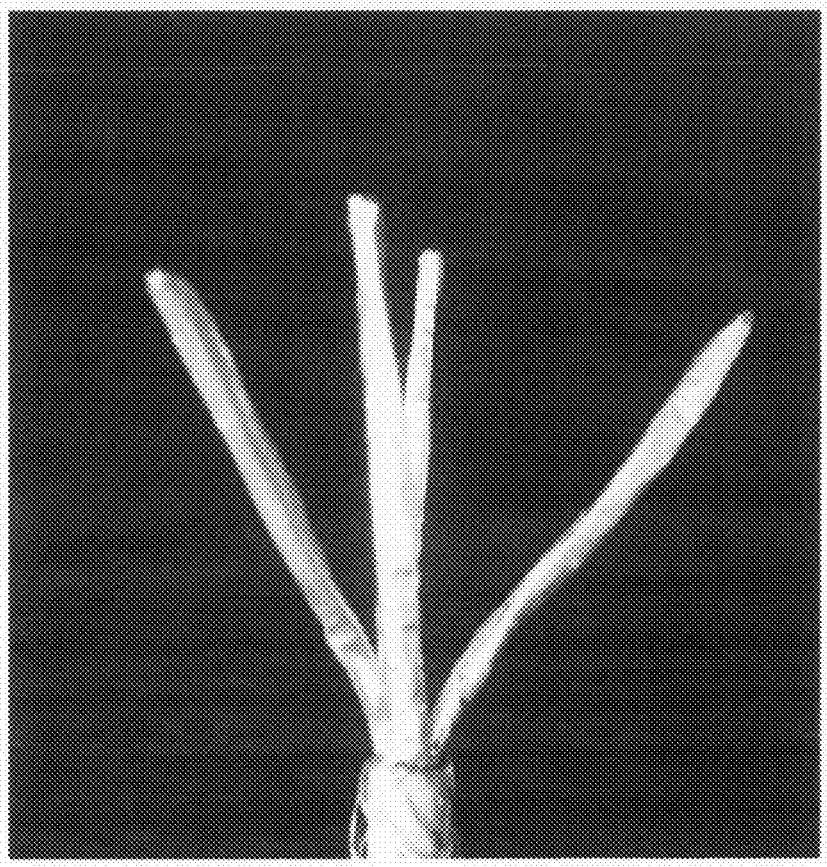
FIG. 13

FIG. 14
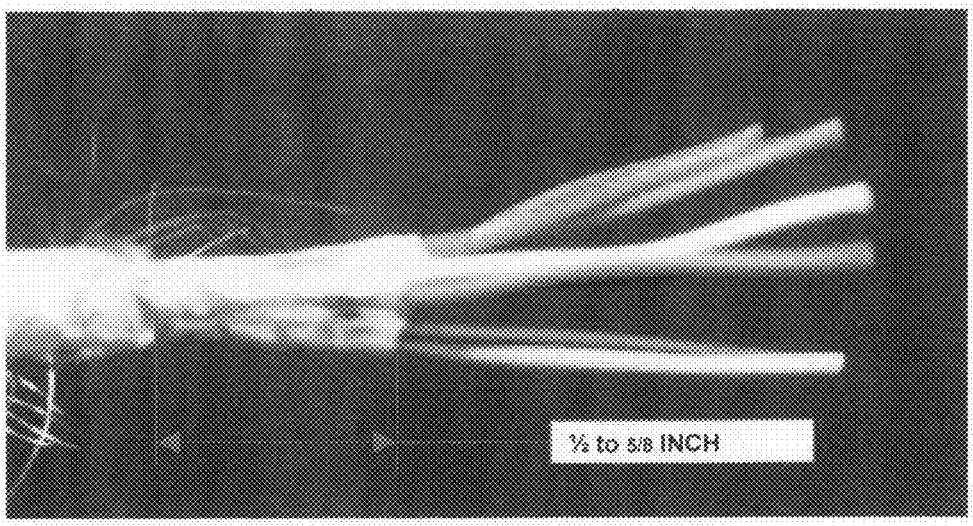
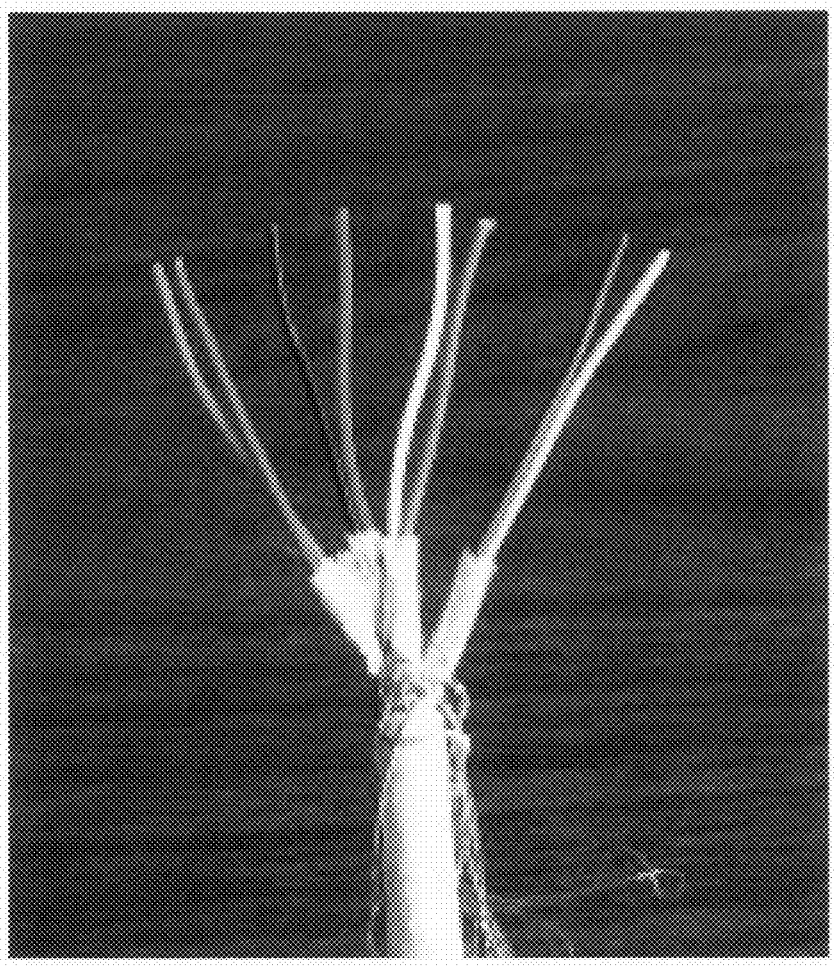
FIG. 15

FIG. 16
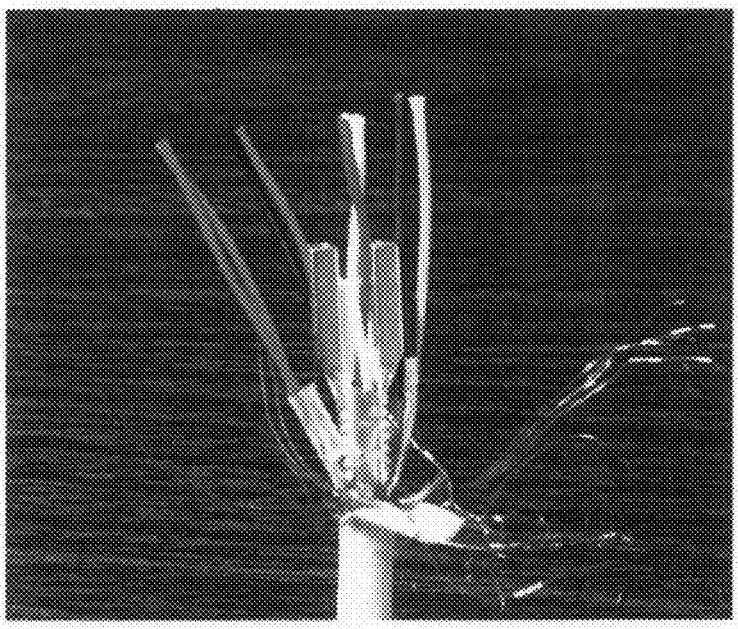
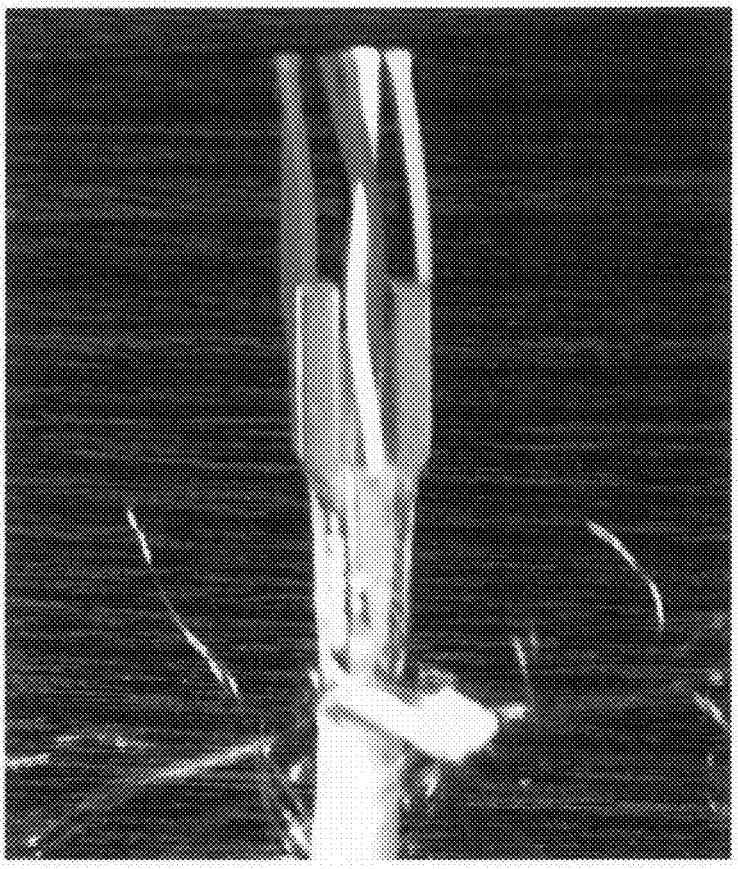
FIG. 17

MODULAR CONNECTOR PLUG HAVING A WIRE GUIDE FILTER WITH AN IMPEDANCE CONTAINING PORTION AND A CABLE GUIDE PORTION

RELATED APPLICATIONS

This application claims the priority filing date of U.S. Provisional Application Ser. No. 61/280,401 filed Nov. 3, 2009.

FIELD OF THE INVENTION

This invention relates generally to modular connectors and, more particularly, to modular connector plugs for high speed applications.

BACKGROUND OF THE INVENTION

The speed of data transmission has increased. New specifications for the performance of modular plugs and jacks reflect the need for higher speed transmission without signal degradation. RJ45 modular plugs and jacks, not originally designed to perform at these levels, must be redesigned to meet the new, ever-increasing performance requirements based on existing infrastructure. While the outline and dimensions of the modular connectors are subject to the U.S. and international standards such as IEC 60603-7 series and TIA 568 series, the internal designs of plugs differ widely. The internal designs are intended to make the plugs satisfy the high speed application requirements.

Presently, the RJ45 connectors are used in applications from 30 KHz to 500 MHz. There are very few modular plugs known that can be used for high speed applications that consistently meet all the major transmission parameters and at the same time are easy to manufacture at low cost and can be used with a variety of cables.

Connector performance is judged by either direct measurement of the transmitted signals or more commonly, by controlling the major transmission parameters such as NEXT, Return loss, Common mode noise and Common to Differential mode conversion. These parameters are specified in the U.S. in TIA 568-10 and internationally in the IEC 60603-7 standard series. The high performance connectors are referred to by categories where category 5e is characterized by applications up to 100 MHz, category 6 by applications up to 250 MHz and category 6a by applications up to 500 MHz. There are several approaches to meet CAT6 and CAT6a performance levels in modular plugs and patchcord assemblies.

The simplest plugs utilize the direct attachment of the plug contacts to the wires without any means to control or modify the position of wires or electrical properties of the assembly. To use these, assemblers must posses a high level of skill and experience to ensure that the conductors are routed correctly. Minor differences in cable handling, pair twisting, foil shield location and wire location can make the difference between cable assemblies that pass or fail the performance requirements. While this design may achieve category 5e or 6 levels, it will not meet such levels consistently and will rarely meet Category 6A performance requirements.

More complex plug designs incorporate printed circuit boards that are used to rout the signals. These designs contain more components and are more expensive to manufacture and assemble. The performance of the PCB plugs is more consistent than the simple plugs noted above. This design can meet CAT 6A, but is very expensive.

There are no designs known that would improve the EMI performance when mated with unshielded jacks.

Thus, a need exists for a modular connector plug which satisfies CAT 6A requirements with improved Near End Cross Talk, Return loss and Common Mode Noise transmission parameters.

SUMMARY OF THE INVENTION

It is an object of the present invention to provide new and improved modular connector plugs for data transmission at speeds from 100 to 500 MHz.

Another object of the present invention to provide new and improved modular connector plugs for data transmission at speeds from 100 to 500 MHz having dimensions and outlines that conform to all existing standards.

Still another object of the present invention to provide new and improved modular connector plugs for data transmission at speeds from 100 to 500 MHz which are easy and economical to manufacture using conventional methods and equipment.

Yet another object of the present invention is to provide new and improved modular connector plugs for data transmission at speeds from 100 to 500 MHz which are easy to apply to cables with consistent repeatable performance.

A further object of the present invention is to provide new and improved modular connector plugs for data transmission at speeds from 100 to 500 MHz which are able to terminate a wide variety of cables of varying construction and manufacture.

A still further object of the present invention is to provide new and improved modular connector plugs for data transmission at speeds from 100 to 500 MHz which when tested in TIA 568A and IEC 60603-7 standards meet and exceed all the requirements specified for category 6A connectors.

Another object of the present invention to provide new and improved modular connector plugs for data transmission at speeds from 100 to 500 MHz which also provide improved EMI performance with both a shielded and unshielded modular connector.

Briefly, these and other objects are attained by providing a modular connector plug comprising a housing formed of insulative material having a longitudinally extending conductor-receiving cavity formed therein opening into a rear surface of the housing, a plurality of contacts situated in a forward region of the housing, the contacts communicating with a forward region of the conductor-receiving passageway, and a wire guide filter at least partially situated in said conductor-receiving cavity through the opening at the rear surface of the housing. The wire guide filter may include an impedance containing portion and an integral or separate internal cable guide portion.

The impedance containing portion comprises a longitudinally extending body having a plurality of longitudinally extending passageways, each of which is structured and arranged to receive a respective conductor pair. The longitudinally extending body of the impedance containing portion may have longitudinally extending walls defining a cross-shaped transverse cross-section and forming four of the longitudinally extending passageways. At least one of the walls of the impedance containing portion may include a longitudinally extending edge surface structured and arranged to terminate a shield of a cable to which the modular connector plug is connected. For example, teeth or serrations may be formed on the longitudinally extending edge surface of at least one of the longitudinally extending walls of the body of the impedance containing portion. The impedance containing portion may be die cast from a zinc alloy, or formed from another material suitable for the purpose such as any conductive material, ferrite, metallized plastic or a non-conductive material.

The internal cable guide portion also comprises a longitudinally extending body defining a plurality of longitudinally extending guide passageways. The cable guide portion is receivable in the conductor-receiving cavity formed in the plug housing.

The plurality of longitudinally extending guide passageways may comprise four guide passageways, each of which is structured and arranged to receive a respective conductor pair. The four guide passageways may include upper and lower guide passageways which are positionable in opposed relationship to the upper and lower surfaces of the conductor-receiving cavity and a pair of side guide passageways positionable contiguous with respective side surfaces of the conductor-receiving cavity, when the internal cable guide portion is received in said conductor-receiving cavity. Each of the pair of side guide passageways may be formed by a wall portion which substantially surrounds the upper, lower and inner sides of the side guide passageway. Alternatively, each of the pair of side guide passageways may be formed by a wall portion which substantially surrounds all of the sides of the side guide passageway in the longitudinal direction. The wall portions forming the guide passageways may be formed of conductive material to provide EMI shielding.

The forward free edge surfaces of the wall portions forming the pair of side guide passageways may be situated forwardly of the forward free edge surfaces of the upper and lower guide passageways to define a controlled cross-talk space between lengths of the wall portions forming the pair of side guide passageways that project forwardly of the forward free edge surfaces of the wall portions forming the upper and lower guide passageways. The internal cable guide portion may be die cast from a zinc alloy or formed from another material suitable for the purpose such as a conductive material, ferrite, metallized plastic or a non-conductive material.

The internal cable guide portion of the wire guide filter may be situated forwardly of the impedance-containing portion of the wire guide filter. The plurality of the longitudinally extending impedance-containing passageways of the impedance-containing portion may be longitudinally aligned with corresponding longitudinally extending guide passageways of the internal cable guide portion. The internal cable guide portion may be formed integrally with the impedance-containing portion. For example, the two portions may be die cast of a zinc alloy as a single component. Alternatively, the two portions may be formed separately from each other of the same or different material.

An outer metallic shield may be situated over the insulative housing of the modular connector plug. The outer shield may include a pair of side portions structured and arranged to overlie outer side surfaces of the housing in opposed relationship to the side guide passageways of the internal cable guide portion situated in the conductor-receiving cavity formed in the housing to provide EMI shielding. The outer shield may also include crimping portions extending away from the housing and structured and arranged to be crimped over the wall portions of the impedance-containing portion to terminate the cable shield.

A load bar may be employed forwardly of the wire guide filter to precisely position the cable conductors in alignment with respective plug contacts.

DESCRIPTION OF THE DRAWINGS

A more complete appreciation of the present invention and many of the attendant advantages thereof will be readily understood by reference to the following detailed description when taken in conjunction with the accompanying drawings in which:

FIGS. 10-27 illustrate the steps for terminating a cable to an embodiment of a modular connector plug in accordance with the invention.

DETAILED DESCRIPTION OF THE PREFERRED EMBODIMENTS

Figure 1:
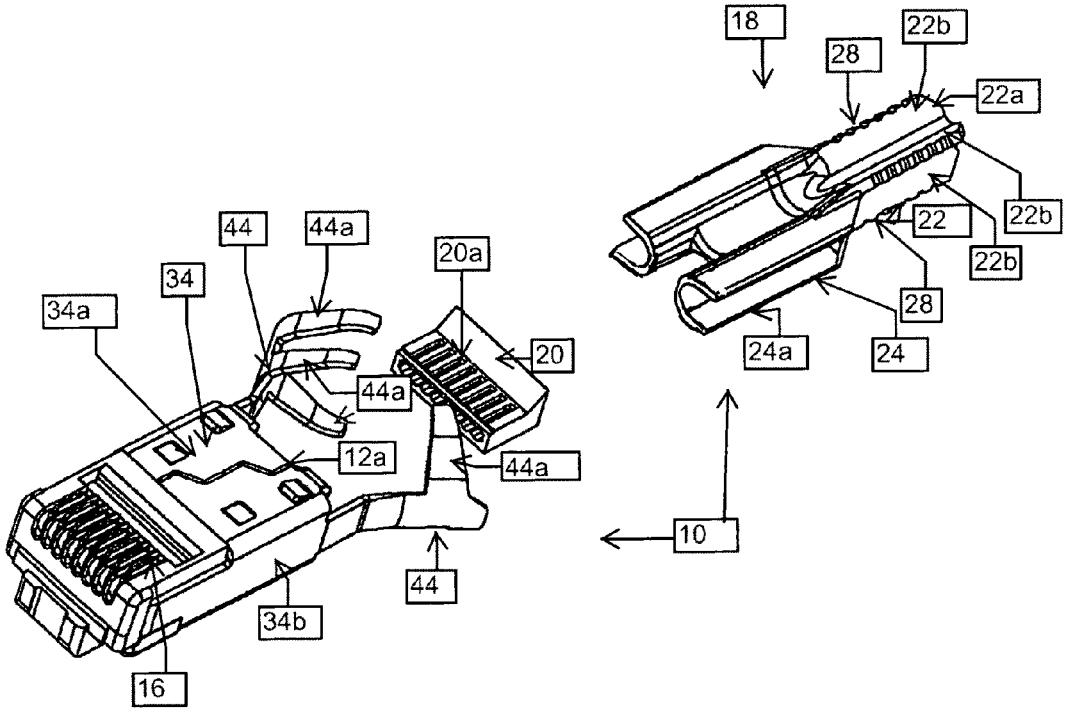
FIG. 1 is an exploded perspective view showing components of one embodiment of a modular connector plug in accordance with the invention.
Figure 5:
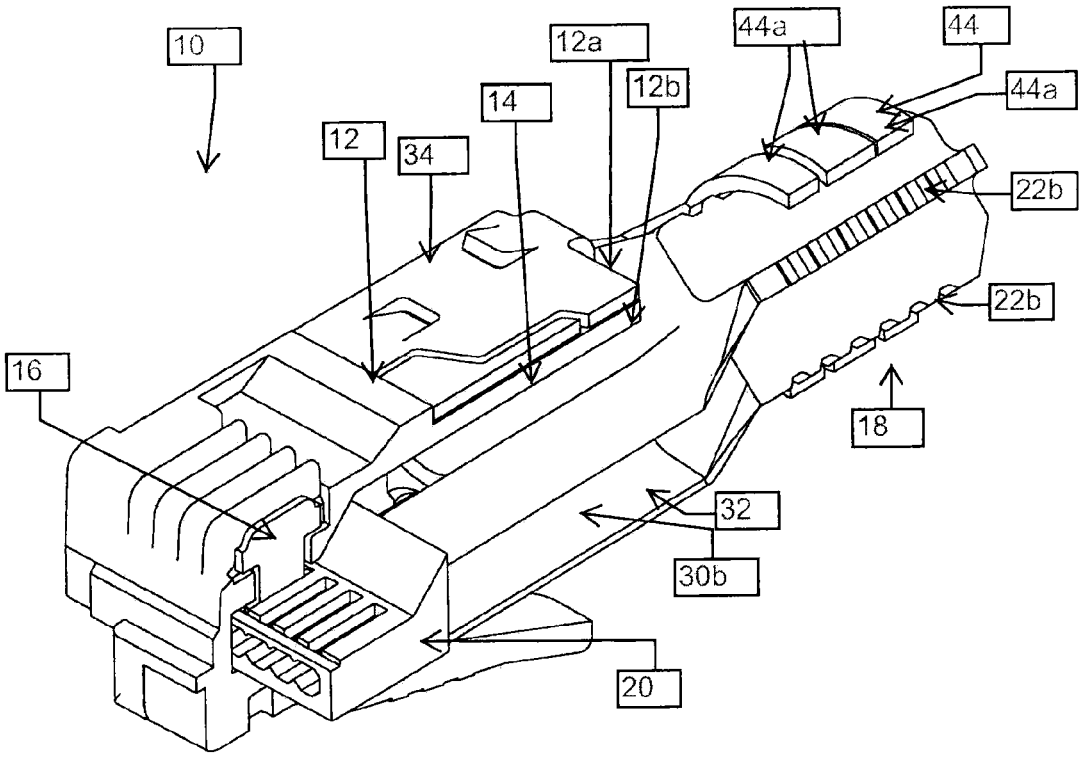
FIG. 5 is a cut-away perspective view of an embodiment of a modular connector plug in accordance with the invention showing a load bar and wire guide filter at least partially situated in a conductor-receiving cavity of the housing of the modular connector plug.
Figure 6:
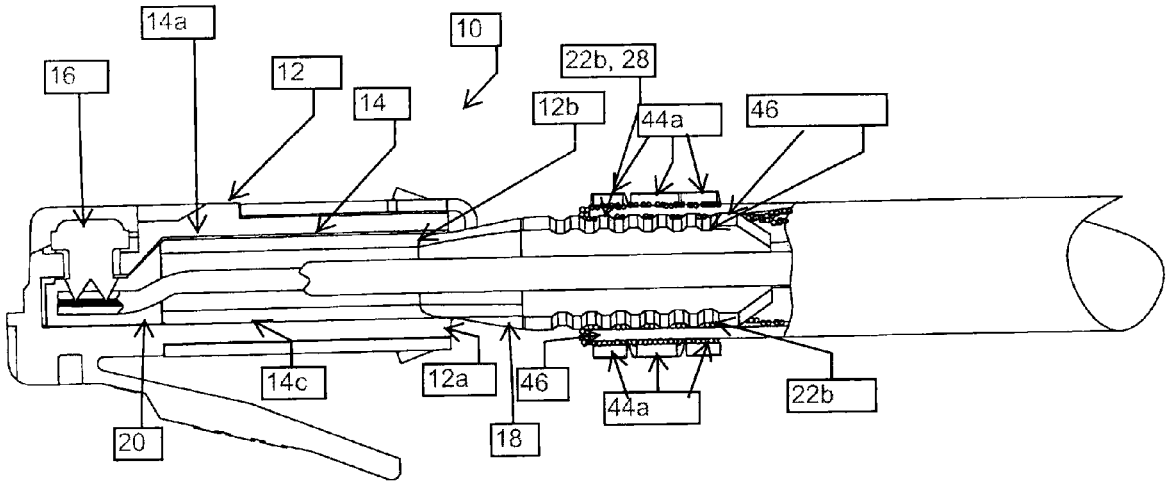
FIG. 6 is a side elevation view in section of an embodiment of an assembly of a modular connector plug and associated cable in accordance with the invention.

Referring now to the drawings wherein like reference characters designate identical or corresponding parts throughout the several views, and more particularly to FIGS. 1, 5 and 6, an embodiment of a modular connector plug in accordance with the invention, designated 10, comprises a housing 12 formed of insulative material, such as plastic, having a longitudinally extending conductor-receiving cavity 14 (see FIGS. 5 and 6) formed therein opening onto a rear surface 12*a* of the housing 12. A plurality of contacts 16, formed of metallic material such as copper alloy or stainless steel, are situated in a forward region of the housing 12. A wire guide filter 18 is at least partially situated in the conductor-receiving cavity 14 through an opening 12*b* (FIG. 6) at the rear surface 12*a* of the housing 12 (see FIGS. 5 and 6). A load bar 20 is situated in the conductor-receiving cavity 14 forwardly of the wire-guide filter 18 for accurately aligning the cable conductors with respective contacts 16.

Figure 2:
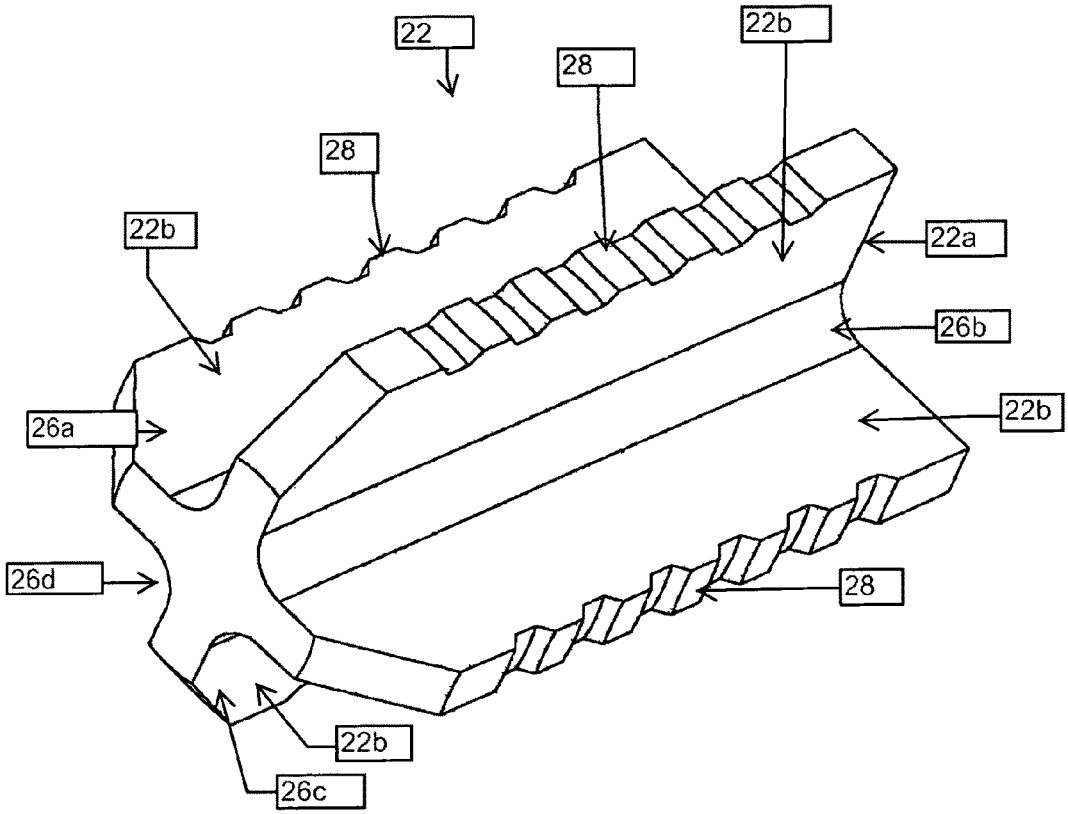
FIG. 2 is a perspective view of an embodiment of an impedance containing portion of a wire guide filter of a modular connector plug in accordance with the invention.

Referring to FIGS. 1 and 2, the wire guide filter 18 includes an impedance-containing portion 22 and an internal cable guide portion 24. The impedance containing portion 22 comprises a longitudinally extending body 22*a* and has a plurality of longitudinally extending passageways, each of which is structured and arranged to receive a respective conductor pair of a cable terminated by the modular connector plug 10. In the illustrated embodiment, the body 22*a* of the impedance-containing portion 22 has four longitudinally extending walls 22*b* defining a cross-shaped transverse cross-section and forming four longitudinally extending passageways 26*a*, 26*b*, 26*c* and 26*d*. Each of the walls 22*b* of the impedance-containing portion 22 includes a serrated or toothed longitudinally extending edge surface 28 arranged to facilitate termination of the shield of the cable as described below. The impedance containing portion is die cast from a zinc alloy, although other suitable materials may be used such as any conductive material, ferrite, metallized plastic or a non-conductive material. As described below, the impedance-containing portion 22 provides shield termination and strain relief for the cable. Each passageway 26*a*, 26*b*, 26*c* and 26*d* holds a respective wire pair of a four-pair cable. The dimensions of the impedance-containing portion corresponds to the cable used for a particular application and minimizes any abrupt disturbance of the cable impedance.

Figure 3:
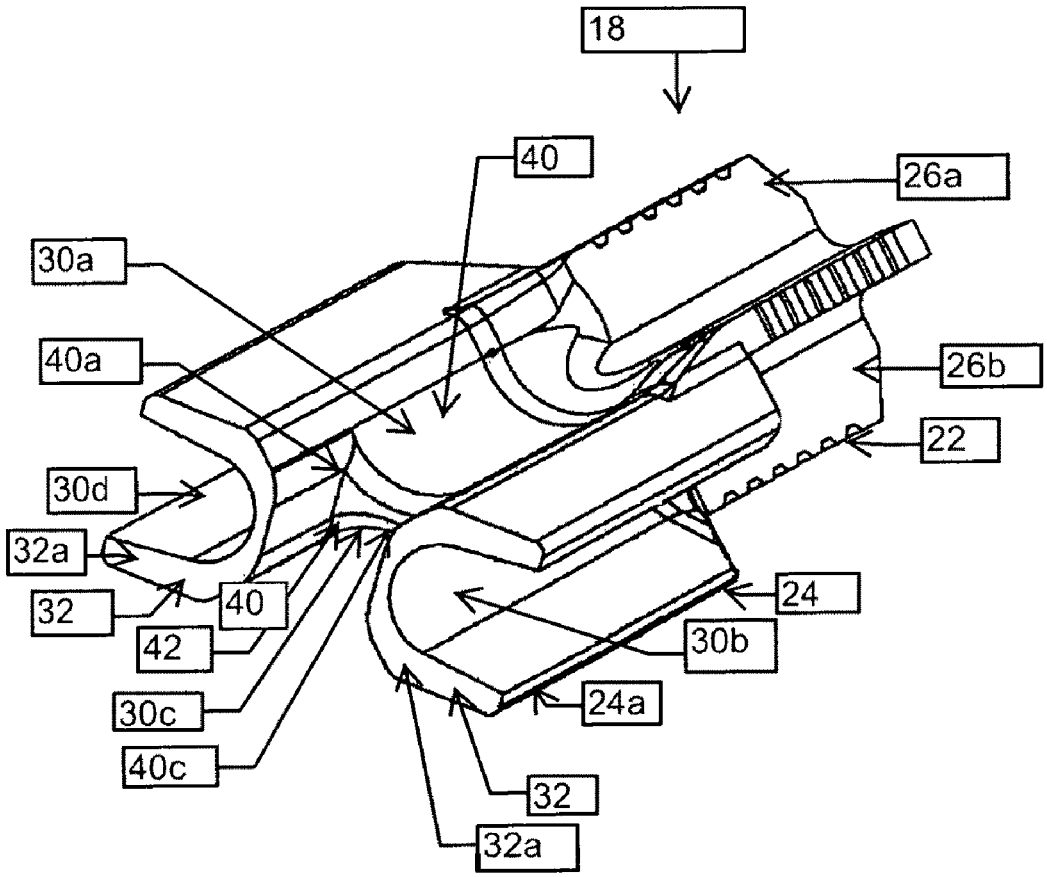
FIG. 3 is perspective view of one embodiment of a wire guide filter of a modular connector plug in accordance with the invention.

Referring to FIGS. 1 and 3, the internal cable guide portion 24 also comprises a longitudinally extending body 24*a* defining a plurality of longitudinally extending guide passageways. The internal cable guide portion 24 is sized so as to be receivable in the conductor-receiving cavity 14 formed in the plug housing 12. In the illustrated embodiment, body 24*a* defines four guide passageways 30*a*, 30*b*, 30*c* and 30*d*, each of which is structured and arranged to receive a respective pair of conductors. The four guide passageways include upper and lower guide passageways 30*a* and 30*c* which are positionable in opposed relationship to the upper and lower surfaces 14*a* and 14*c* of the conductor-receiving cavity 14 (see FIG. 6) respectively. The four guide passageways also include side guide passageways 30*b* and 30*d* which are positionable in opposed and contiguous relationship to the side surfaces 14*b* and 14*d* (not seen) of the conductor-receiving cavity 14. In the embodiments shown in FIGS. 1, 3 and 5, each of the side guide passageways 30*b* and 30*d* is formed by a wall portion 32 which substantially surrounds the upper, lower and inner sides of the respective side guide passageways 30*b* and 30*d*. The side guide passageways 30*b* and 30*d* effectively provide EMI shielding to the wire pairs that pass therein.

The four guide passageways 30*a*-30*d* of wire guide filter 18 guide the four twisted conductor pairs of the cable. The guide passageways hold the pairs in position and maintain the location of the pairs relative to each other which is important in connection with producing parts with consistent and repeatable performance. The wire guide filter 18 is formed of die cast zinc alloy or other conductive material that shields the four pairs of conductors from each other thereby preventing cross-talk between the pairs. The location and length of the wall portions 32 may be varied to provide optimum performance.

Alternatively, the wire guide filter 18 may be formed of ferrite material which, in addition to shielding the four conductor pairs from each other, absorbs electromagnetic emissions. Only parasitic common mode noise will be absorbed by the ferrite material. Useful differential signals are not affected.

In the embodiment shown in FIGS. 1, 3 and 5, i.e, embodiments in which the wall portions 32 of side guide passageways 30*b* and 30*d* do not cover the outer sides of the side guide passageways, an outer shield 34 surrounds portions of the exterior surfaces of the housing 12 of the modular connector plug and includes top 34*a*, bottom 34*c*, and side shield portions 34*b* and 34*d* covering top, bottom and side surface of the plug housing. The side shield portions (only 34*b* shown in FIG. 1), together with the wall portions 32 defining the side guide passageways, completely surround the side guide passageways and provide effective EMI shielding for the cable pairs that pass therethrough. It is important that the internal diameter of the side guide passageways is greater than that of the cable wire pairs, thus reducing electromagnetic emissions.

Figure 4:
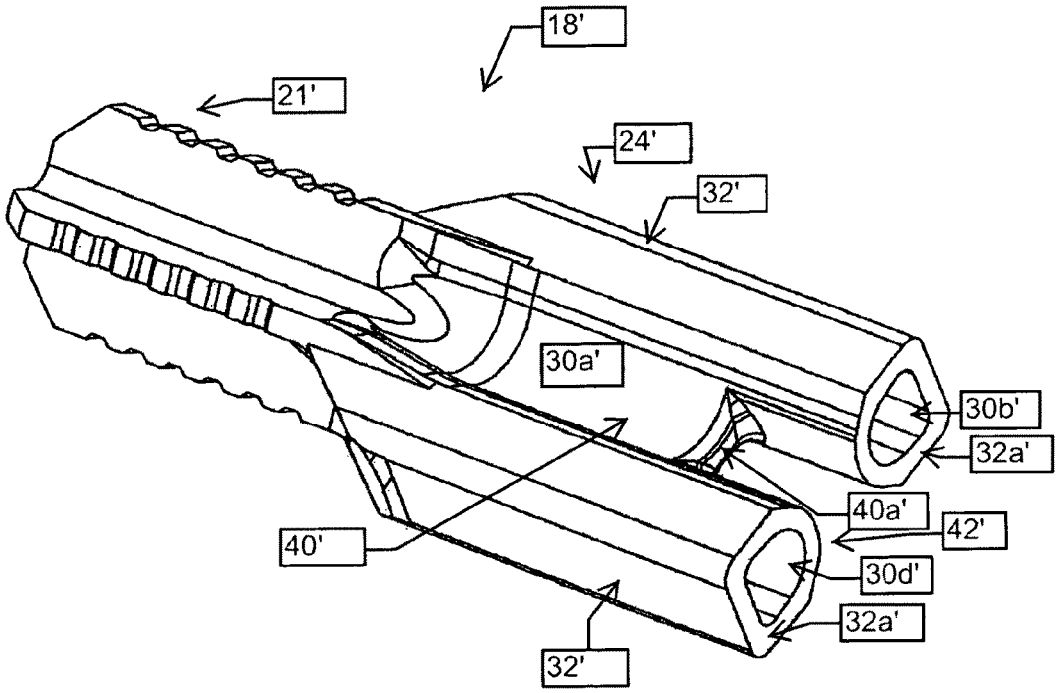
FIG. 4 is a perspective view of another embodiment of a wire guide filter of a modular connector plug in accordance with the invention.

Referring to FIG. 4, another embodiment of a wire guide filter 18' is illustrated. Parts corresponding to similar parts of the wire guide filter 18 shown in FIG. 3 are designated by the same reference numeral, primed. Wire guide filter 18' is similar to the wire guide filter 18 shown in FIG. 3 in that it includes impedance-containing portion 22' and internal cable guide portion 24' integrally joined to each other. In the case of the embodiment shown in FIG. 4, the side guide passageways 30*b'* and 30*d'* are completely surrounded by the wall portions 32' which extend around the entire circumference of the side guide passageways 30*b'* and 30*d'*. This embodiment of the wire guide filter 18' can be used with both shielded plugs of the type shown in FIG. 1 (shield 34) as well as unshielded plugs and achieve improved EMI performance in either application.

Figure 7:
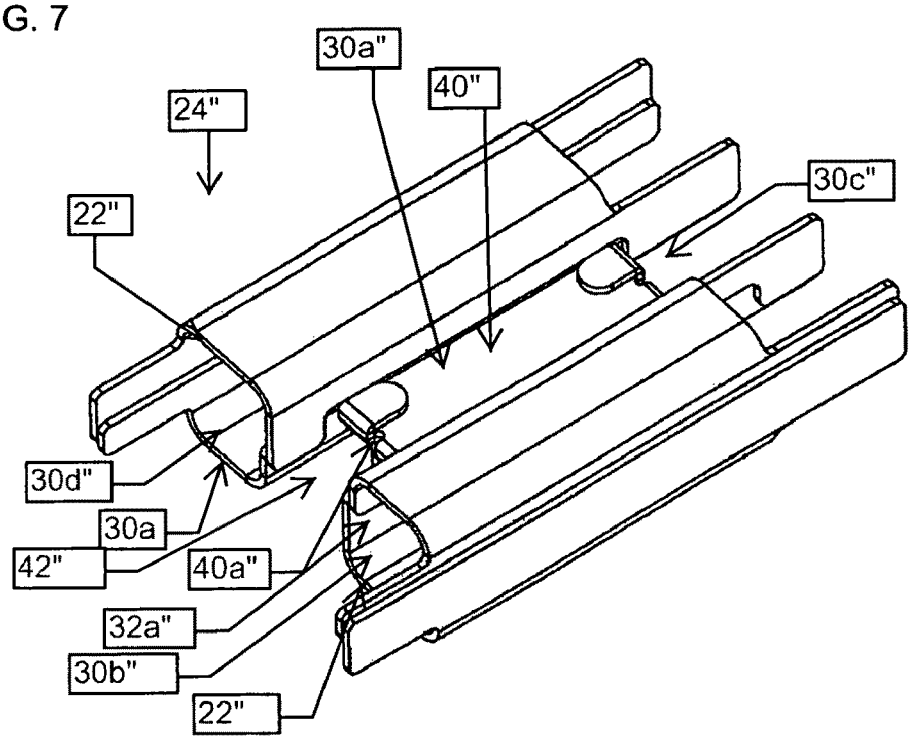
FIG. 7 is a perspective view of another embodiment of an internal cable guide portion of a wire guide filter of a modular connector plug in accordance with the invention.
Figure 8:
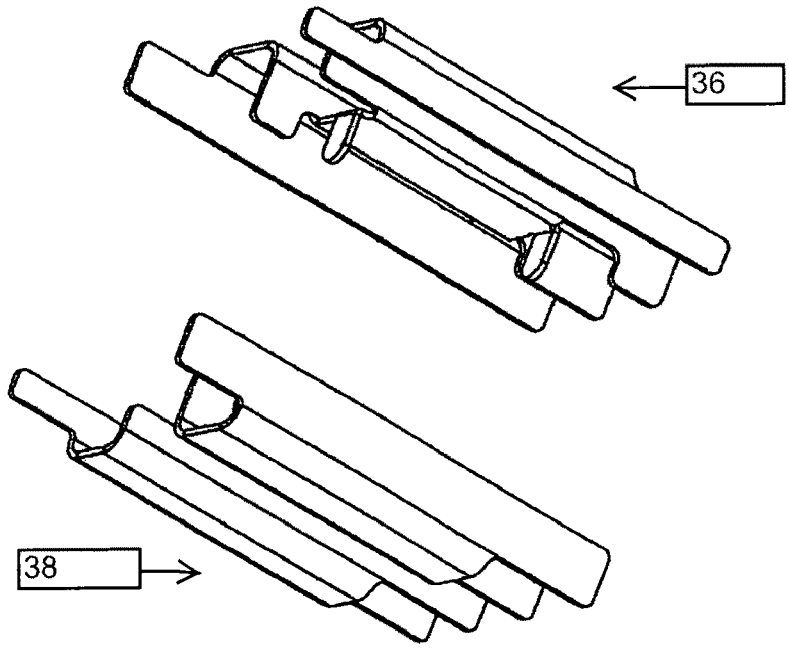
FIG. 8 is an exploded perspective view of the components of the internal cable guide portion of FIG. 7.
Figure 9:
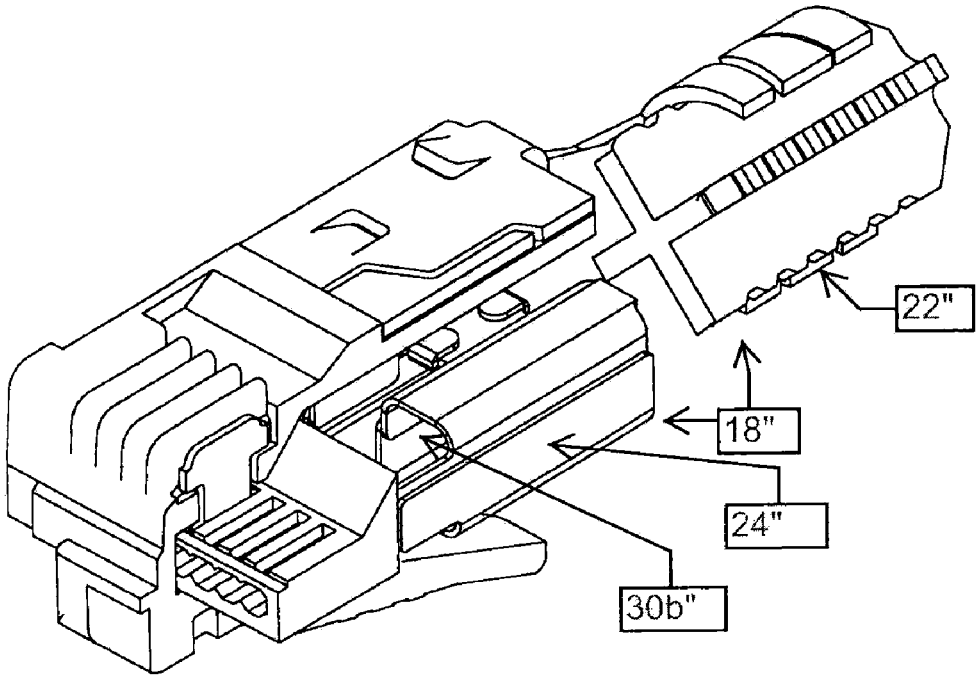
FIG. 9 is a cut-away perspective view of an embodiment of a modular connector plug in accordance with the invention utilizing the internal cable guide portion of FIGS. 7 and 8.

Referring to FIGS. 7-9, another embodiment of a wire guide filter 18" is illustrated (see FIG. 9). Parts corresponding to similar parts of the wire guide filter 18 shown n FIG. 3 are designated by the same reference numeral, double primed. Wire guide filter 18" includes an impedance-containing portion 22" and a separate internal cable guide portion 24". The internal cable guide portion 24" is formed of conductive sheet metal, such as copper alloy and comprises upper and lower parts 36 and 38 (FIG. 8) which mate with each other as seen in FIG. 7 to form the cable guide portion 24". The cable guide portion 24" includes longitudinally extending guide passageways 30*a"*-30*d"*. Side guide passageways 30*b"* and 30*d"* are shielded on all sides around their entire length by the wall portions 22" so that the embodiment of a wire-guide filter 18" effectively improves EMI performance with both shielded and unshielded modular connector plugs.

Referring to the embodiments of the internal cable guide portions 24, 24' and 24" shown in FIGS. 3, 4 and 7, the forward free edge surfaces 32*a*, 32*a'* and 32*a"* of wall portions 32, 32' and 32" are situated forwardly of forward free surfaces 40*a*, 40*a'* and 40*a"* of wall portions 40 that form the top and bottom guide passageways 30*a*, 30*c*; 30*a'*, 30*c'*, 30*a"*, 30*c'*. This construction defines a controlled cross-talk space 42, 42', 42" between the lengths of the wall portions 32, 32', 32" forming the pair of side guide passageways that project forwardly of the forward free edge surfaces of the wall portions 40, 40', 40" forming the upper and lower guide passageways. The controlled cross-talk area 42, 42', 42" is used in both shielded and unshielded embodiments of the modular connector plug. For example, when utilizing a T568B wiring scheme, in assembly, the exposed lengths of conductor pairs 1, 2 and 7, 8 are different from the exposed lengths of conductor pairs 3, 6 and 4, 5, namely, the 3,6 and 4, 5 pairs have a shorter shield length. These exposed lengths of the conductor pairs control the coupling between the pairs to improve performance to CAT 6A levels by cancelling out cross-talk between the contacts of opposite polarity. Because these optimized lengths are built (e.g., cast) into the cable guide portion 24, 24', 24", they do not have to be tightly controlled during cable preparation. In other words, the foil shields of the individual conductor pairs need not be trimmed to a tight tolerance. As long as the foils are within the guides passageways, the shield length is controlled by the construction of the cable guide portion. In an embodiment in which the modular connector plug is unshielded, the goal is to control the separation of the conductors from each other. Preferably, the length of the controlled cross-talk space 42, 42', 42" for either shielded or unshielded modular connector plugs is up to about 0.350". Appropriate sizing of the controlled cross-talk space can provide sufficient cross-talk to achieve performance up to even CAT 7A levels.

Referring to FIGS. 1, 5, and 6, crimping portions 44 are formed integrally with shield 34 and extend rearwardly so as to lie adjacent to the impedance-containing portion 22 when the internal cable guide portion 24 is situated within the conductor-receiving cavity 14. The crimping portions 44 include crimping fingers 44*a* which are structured and arranged to be crimped over the wall portions of the impedance-containing portions to hold the cable shield 46 (FIG. 6) against the serrated edge surfaces 28 of the longitudinally extending walls 22*b* of the impedance-containing portion 22. The fingers 44*a* of the crimping portions 44 thus terminate the cable shield 46 to the impedance-containing portion 22 providing a secure strain relief and low resistance electrical connection. The longitudinally extending passageways 26*a*-26*d* provide space for the conductors to pass under the crimping fingers 44*a* protecting them from deformation that can degrade their electrical transmission performance.

The load bar 20 has a greater opening in the front thereby facilitating cable insertion. The slots 20*a* (FIG. 1) for receiving the plug contacts are closed on four sides to control the position of the contact and further make the electrical properties more consistent.

Referring to FIGS. 10-27, the assembly of a modular connector plug in accordance with the invention to a cable including four twisted pairs of conductors is shown.

Figure 18:
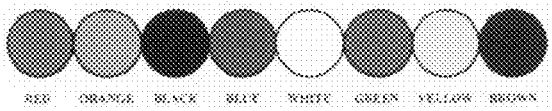
Figure 19:
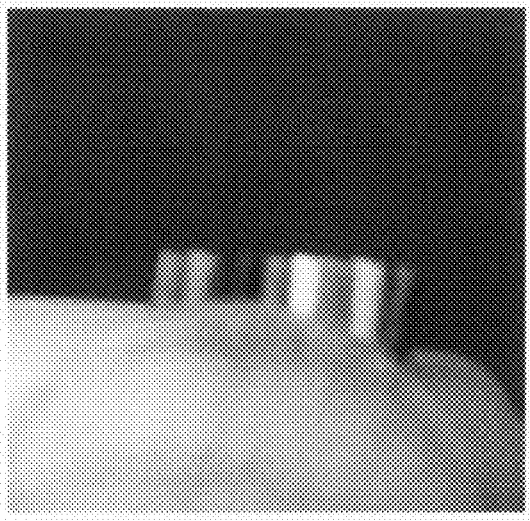
Figure 20:
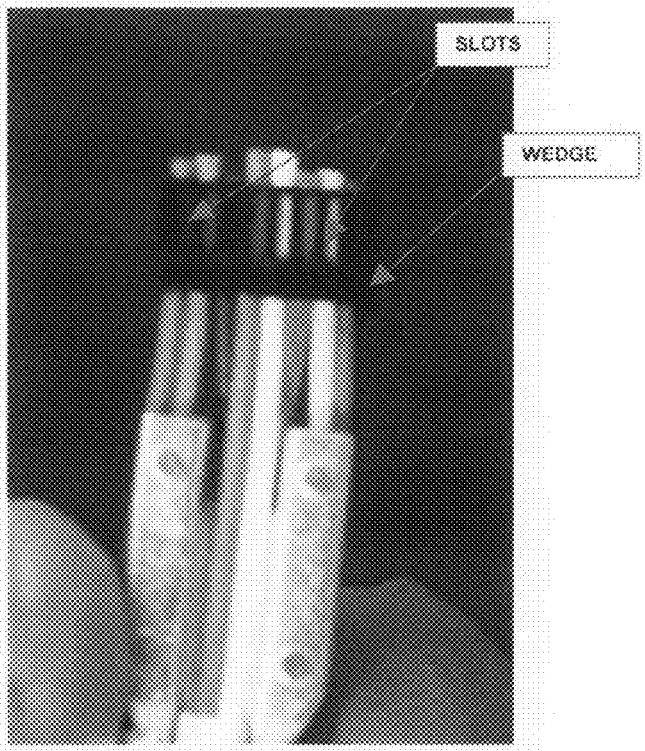
Figure 21:
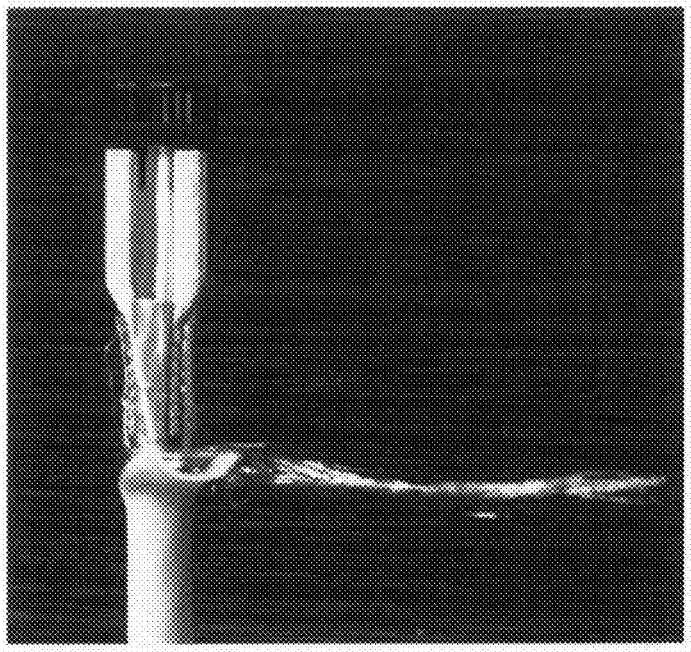
Figure 22:
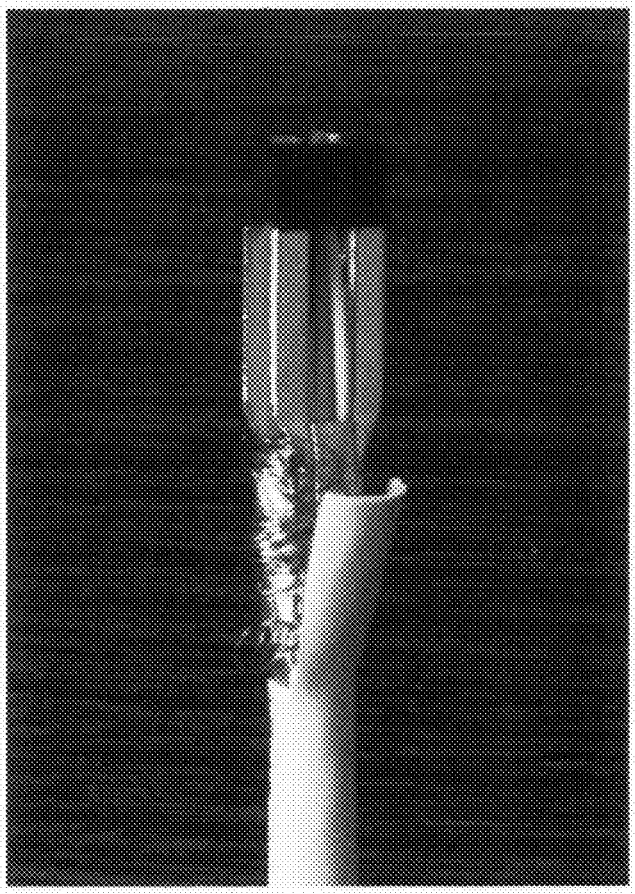
Figure 23:
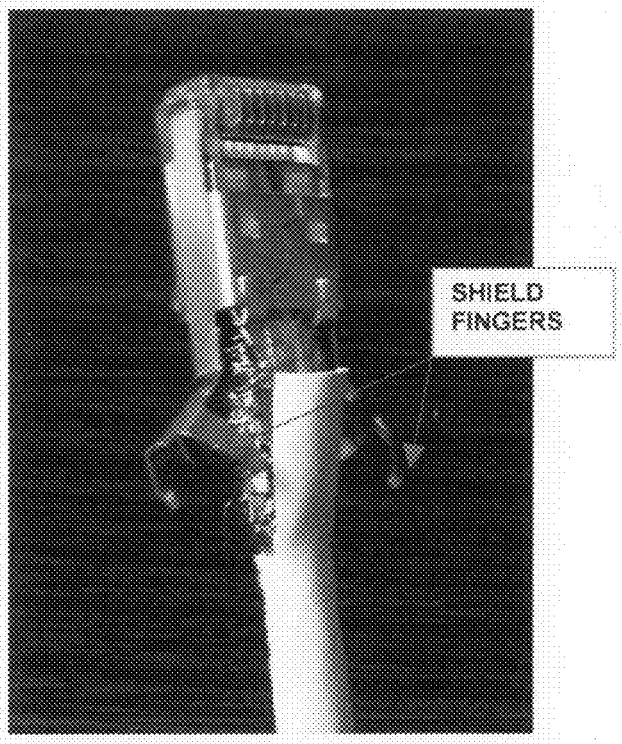
Figure 24:
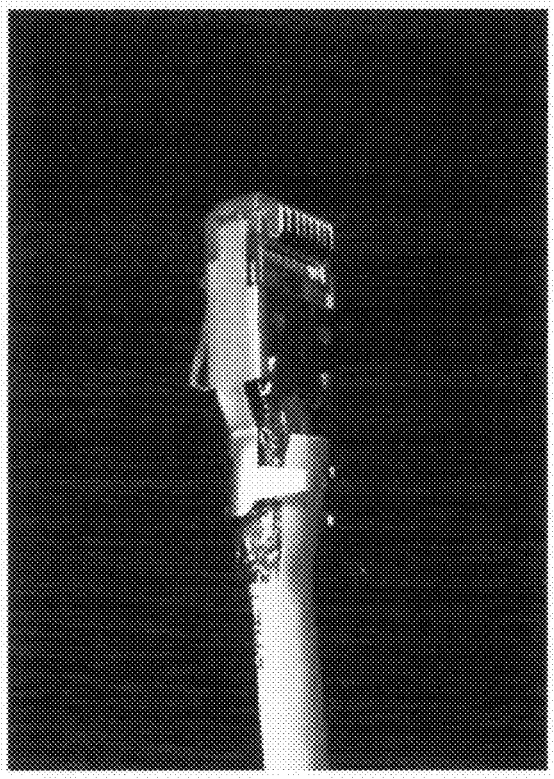
Figure 25:
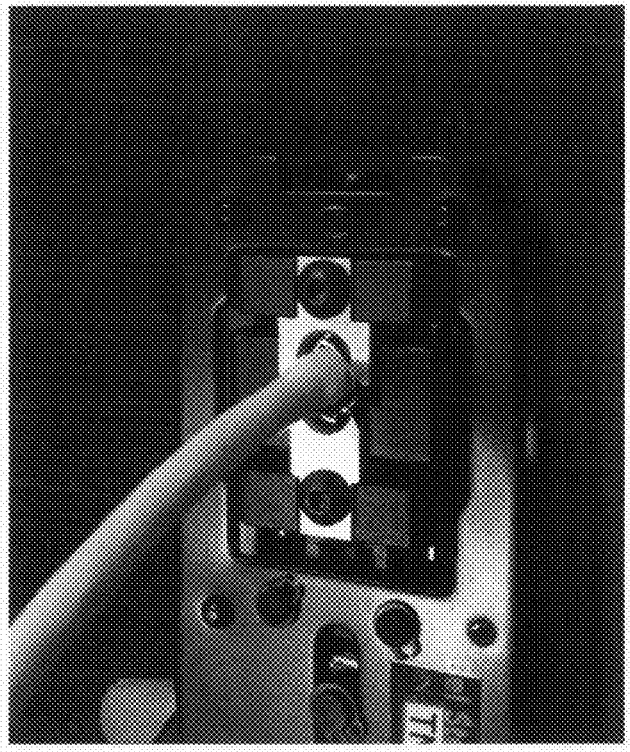
Figure 26:
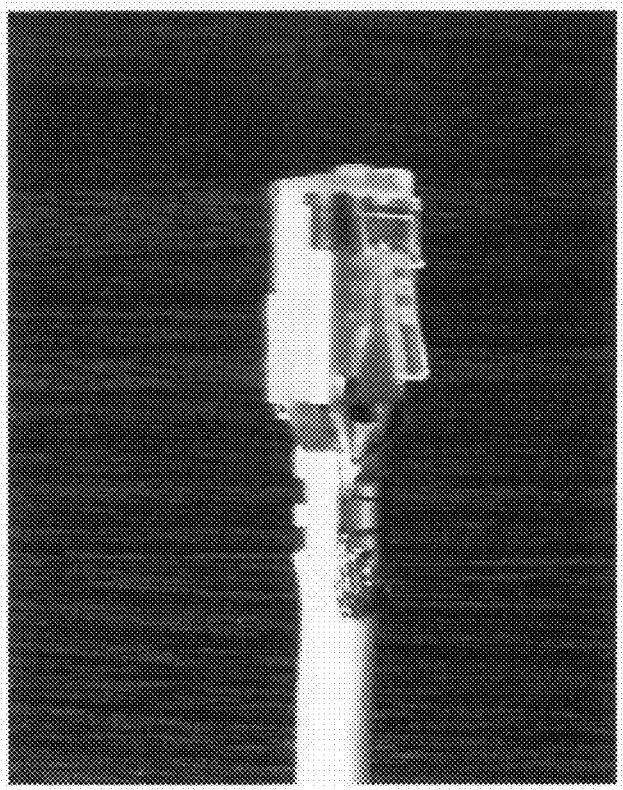
Figure 27:
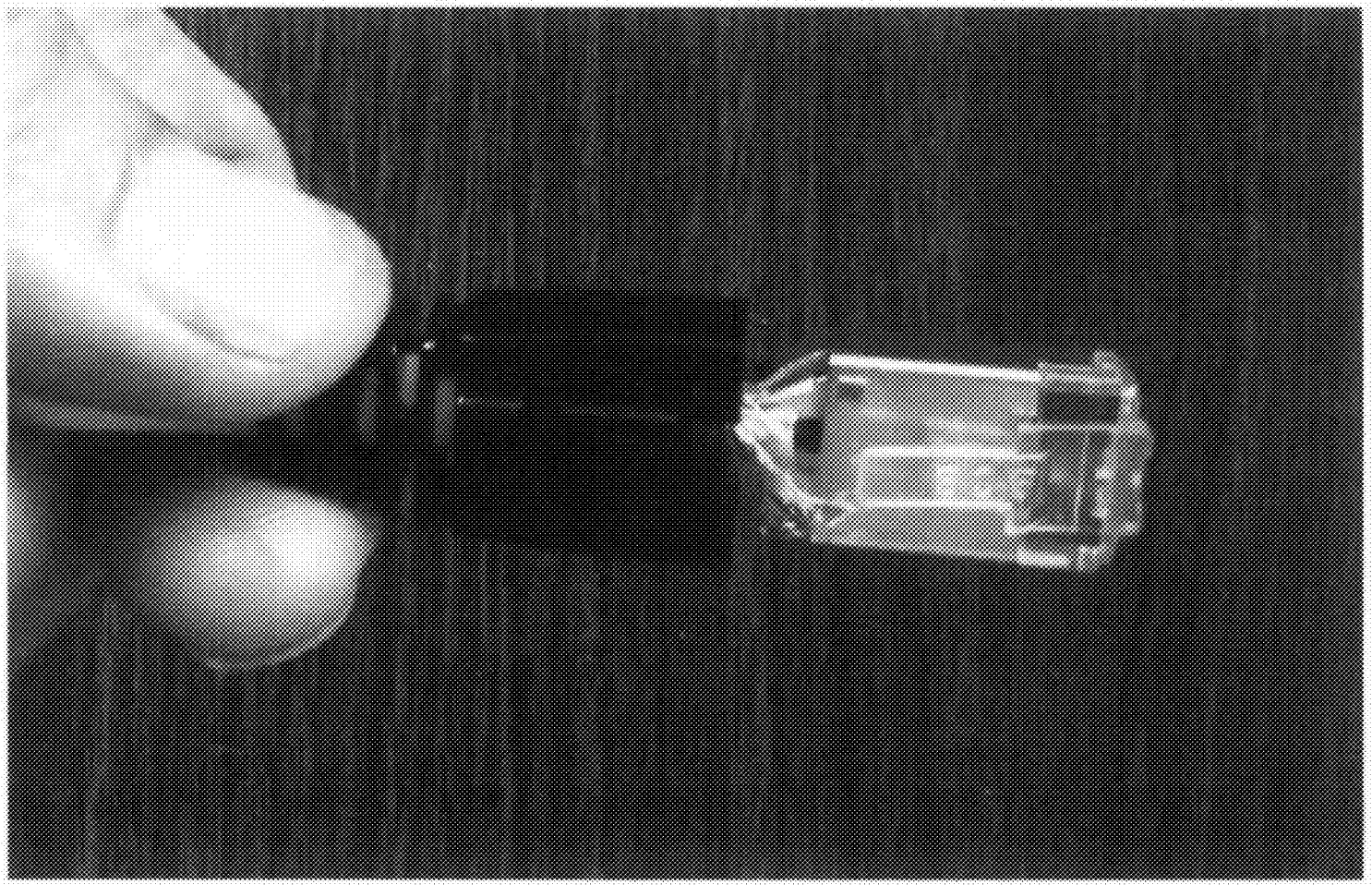

In the illustrated embodiment, in which the plug 10 shown in FIGS. 1-3, 5 and 6 is terminated to a cable having four wire pairs, referring to FIG. 10, a cable is cut to length and strain relief grommets are slid over the cable with the larger ends facing outward. Referring to FIG. 11, the outer jacket of the cable is slit and about 1½ to 1¾ inches of the jacket is stripped off on one side. A flap of about ½ to ⅝ inches of the jacket is left on the other side. Referring to FIG. 12, the jacket flap is pulled back and the braid is pulled back over the cable jacket. Referring to FIG. 13, the four wire pairs are spread out and, referring to FIG. 14, the foil is trimmed from the wire pairs leaving about ½ to ⅝ inches of foil remaining on each wire pair. Referring to FIG. 15, the exposed wires are untwisted and the pairs are arranged so that the orange pair is on the left and the brown pair is on the right with the free ends of the wires pointing up. The blue and green pairs are situated in the middle. Referring to FIGS. 16 and 17, the end of the wire guide filter 18 is pushed between the wire pairs so that the wires of each wire pair are situated in a respective pair of longitudinally extending passageways 26*a*-26*d* of impedance-containing portion 22 and aligned longitudinally extending guide passageways 30*a*-30*d* of internal cable guide portion 24. In particular, the orange and brown pairs are situated in the side passageways while the blue and green pairs are situated in the upper and lower passageways. Referring to FIGS. 18 and 19, the portions of the wires projecting forwardly of the internal cable guide portion 24 are flattened and arranged to mach the T568B color map (FIG. 18) and the tips of the wires are trimmed straight across so that their ends are even (FIG. 19). Referring to FIG. 20, the ends of the wires are inserted into the load bar 20 maintaining the color sequence. Referring to FIG. 21, the load bar 20 is pushed firmly down the wires until the load bar is fully bottomed against the internal shield. The portions of the wires projecting through the load bar are trimmed flush with the end of the load bar and all of the braid is pulled to one side of the jacket. Referring to FIG. 22, the braid is wrapped around the narrow end of the internal shield in the area in which the plug shield fingers 44*a* contact the narrow end of the shield when crimped. The braid becomes situated under the flap of the jacket. Referring to FIG. 23, with the orange pair of wires on the left, the assembled wires, load bar and wire-guide filter 18 are pushed into the conductor-receiving cavity 14 of the plug housing 12*a* until the wires come into contact with the front inside surface of the plug. Referring to FIGS. 24 and 25, the shield fingers 44 are then bent inwardly towards the cable and are crimped to the cable and wire shield using a suitable crimping tool. The terminated plug cable assembly is removed from the crimping tool (FIG. 26). Finally, the relief grommet is pushed over the terminated plug.

Obviously, numerous modifications and variations of the present invention are possible in light of the above teachings. It is therefore to be understood that within the scope of the claims appended hereto, the invention may be varied from the embodiments disclosed herein.

We claim:

1. A modular connector plug, comprising:

a housing formed of insulative material having a longitudinally extending conductor-receiving cavity formed therein opening onto a rear surface of said housing;

a plurality of contact-receiving slots formed in a forward region of said housing, said contact-receiving slots communicating with a forward region of said conductor-receiving cavity; and a wire guide filter at least partially situated in said conductor-receiving cavity through said opening at said rear surface, said wire guide filter including an impedance containing portion and an internal cable guide portion.

2. A modular connector plug as recited in claim 1 wherein said impedance containing portion comprises a longitudinally extending body having a plurality of longitudinally extending passageways.

3. A modular connector plug as recited in claim 2 wherein said longitudinally extending body of said impedance containing portion has a cross-shaped cross-section defining four of said longitudinally extending passageways.

4. A modular connector plug as recited in claim 2 wherein said longitudinally extending body of said impedance containing portion includes a plurality of longitudinally extending walls defining said plurality of longitudinally extending passageways between them.

5. A modular connector plug as recited in claim 4 wherein at least one of said longitudinally extending walls includes a longitudinally extending edge surface structured and arranged to terminate a shield of a cable to be received in said conductor-receiving cavity.

6. A modular connector plug as recited in claim 5 wherein teeth or serrations are formed on said longitudinally extending edge surface of said at least one wall.

7. A modular connector plug as recited in claim 1 wherein said impedance containing portion comprises a longitudinally extending body including at least one edge surface structured and arranged to terminate a shield of a cable to be received in said conductor-receiving cavity.

8. A modular connector plug as recited in claim 1 wherein said impedance containing portion is formed of a zinc alloy.

9. A modular connector plug as recited in claim 1 wherein said impedance containing portion is formed of a metalized plastic.

10. A modular connector plug as recited in claim 1 wherein said impedance containing portion is formed of a non-conductive material.

11. A modular connector plug as recited in claim 1 wherein said impedance containing portion is formed of a ferrite material.

12. A modular connector plug as recited in claim 1 wherein said internal cable guide portion comprises a longitudinally extending body defining a plurality of longitudinally extending guide passageways.

13. A modular connector plug as recited in claim 12 wherein said internal cable guide portion is receivable in said conductor-receiving cavity formed in said plug housing.

14. A modular connector plug as recited in claim 13 wherein said plurality of longitudinally extending guide passageways comprises four said guide passageways including upper and lower guide passages situatable contiguous with upper and lower surfaces of said conductor-receiving cavity and a pair of side guide passageways situatable contiguous with respective side surface of said conductor-receiving cavity.

15. A modular connector plug as recited in claim 14 wherein each of said pair of side guide passageways is formed by a wall portion substantially surrounding at least upper, lower and inner sides of said guide passageways.

16. A modular plug connector as recited in claim 15 wherein each of said pair of side guide passageways is formed by a wall portion which substantially surrounds all of the sides of said side guide passageways.

17. A modular plug connector as recited in claim 15 wherein each of said wall portions forming the guide passageways is formed of a conductive material.

18. A modular plug connector as recited in claim 14 wherein each of said pair of side guide passageways is formed by a wall portion, each of which is structured and arranged to provide EMI shielding of said side guide passageways.

19. A modular plug connector as recited in claim 14 wherein each of said upper, lower and pair of side guide passageways are formed by respective longitudinally extending wall portions, each guide passageway wall portion terminating at a forward free surface.

20. A modular plug connector as recited in claim 19 wherein said forward free surface of said wall portions forming said pair of side guide passageways are situated forwardly of said forward free surface of said wall portions forming said upper and lower guide passageways.

21. A modular plug connector as recited in claim 20 wherein a controlled cross-talk space is defined between lengths of said wall portions forming said pair of side guide passageways that project forwardly of said forward free surfaces of said wall portions forming said upper and lower guide passageways.

22. A modular plug connector as recited in claim 1 wherein said impedance containing portion of said wire guide filter comprises a first longitudinally extending body have a plurality of longitudinally extending impedance containing passageways, wherein said internal cable guide portion of said wire guide filter comprises a second longitudinally extending body defining a plurality of guide passageways; wherein said internal cable guide portion is situated forwardly of said impedance containing portions; and wherein at least some of said plurality of longitudinally extending impedance containing passageways are longitudinally aligned with corresponding longitudinally extending guide passageways.

23. A modular connector plug as recited in claim 22 wherein each of said impedance-containing and internal cable guide portions comprise four of said impedance containing and guide passageways respectively, including aligned upper, lower and pairs of side impedance containing and guide passageways.

24. A modular connector plug as recited in claim 23 wherein said internal cable guide portion is situated within said conductor-receiving passageway, said upper and lower guide passageways situated contiguous with upper and lower surfaces of said conductor-receiving cavity and said side guide passageways situated contiguous with side surfaces of said conductor-receiving passageways.

25. A modular connector plug as recited in claim 22 wherein said impedance-containing portion and said internal cable guide portion are integrally formed with each other.

26. A modular connector plug as recited in claim 22 wherein said impedance-containing portion and said internal cable guide portion are formed separately from each other.

27. A modular connector plug as recited in claim 23 wherein each of said upper, lower and pair of side guide passageways are formed by respective longitudinally extending wall portions, each guide passageway wall portion terminating at a forward free surface.

28. A modular connector plug as recited in claim 27 wherein said forward free surface of said wall portions forming said pair of side guide passages are situated forwardly of said forward free surface of said wall portions forming said upper and lower guide passageways.

29. A modular plug connector as recited in claim 28 wherein a controlled cross-talk space is defined between lengths of said wall portions forming said pair of side guide passageways that project forwardly of said wall portions forming said upper and lower guide passageways.

30. A modular plug connector as recited in claim 23 wherein each of said pair of side guide passageways is formed by a wall portion substantially surrounding at least upper, lower and inner sides of said side guide passageways.

31. A modular plug connector as recited in claim 23 each of said pair of side guide passageways is formed by a wall portion surrounding all the sides of said side guide passageway.

32. A modular plug connector as recited in claim 23 wherein each of said pair of side guide passageways is formed by a wall portion surrounding all the sides of said side guide passageways.

33. A modular plug connector as recited in claim 32 wherein each of said wall portions is formed of conductive material.

34. A modular plug connector as recited in claim 33 wherein each of said pair of side guide passageways is formed by a wall portion, each wall portion being structured and arranged to provide EMI shielding of said side guide passageways.

35. A modular plug connector as recited in claim 23 further including an outer shield member situated on outer surfaces of said modular connector plug housing.

36. A modular plug connector as recited in claim 35 wherein said outer shield member includes portions overlying an outer surface of said housing in opposed relationship to said side guide passageways of said internal cable guide portion situated in said conductor-receiving cavity formed in said housing to provide EMI shielding.

37. A modular plug connector as recited in claim 23 further including strain relief portions formed on said impedance containing portion.

38. A modular plug connector as recited in claim 1 further including an outer shield member situated on an outer surface of said modular connector plug housing.

39. A modular plug connector as recited in claim 38 wherein said outer shield member includes crimping portions extending away from said housing and structured and arrange to be crimped over said impedance containing portion to terminate a cable shield.

* * * * *